US006170365B1

(12) United States Patent
Zerver

(10) Patent No.: US 6,170,365 B1
(45) Date of Patent: Jan. 9, 2001

(54) SOCKET WRENCH EXTENSION

(75) Inventor: Hermann J. Zerver, Remscheid (DE)

(73) Assignee: Hazet-Werk Hermann Zerver GmbH & Co. KG (DE)

( * ) Notice: Under 35 U.S.C. 154(b), the term of this patent shall be extended for 0 days.

(21) Appl. No.: 09/169,670

(22) Filed: Oct. 9, 1998

(30) Foreign Application Priority Data

Oct. 10, 1997 (DE) ..... 197 44 865

(51) Int. Cl.[7] ..... B25B 23/16
(52) U.S. Cl. ..... 81/177.85; 81/177.2
(58) Field of Search ..... 81/177.2, 177.85; 403/322.2, 325, 326, 327, 328, 361

(56) References Cited

U.S. PATENT DOCUMENTS

| | | | | |
|---|---|---|---|---|
| 1,651,361 | * | 12/1927 | Ayotte | 81/177.2 |
| 4,399,722 | | 8/1983 | Sardo, Jr. . | |
| 4,703,677 | * | 11/1987 | Rossini | 81/177.2 |
| 4,733,584 | | 3/1988 | Karge . | |
| 5,289,745 | | 3/1994 | Beardsley . | |
| 5,433,548 | | 7/1995 | Roberts et al. . | |

FOREIGN PATENT DOCUMENTS

| | | |
|---|---|---|
| 1170336 | 5/1957 | (DE) . |
| 2118858 | 11/1972 | (DE) . |
| 2848243 | 5/1980 | (DE) . |
| 32 14 867 | 10/1983 | (DE) . |
| 89096452 | 1/1991 | (DE) . |
| 162092 | 10/1991 | (JP) . |

* cited by examiner

*Primary Examiner*—David A. Scherbel
*Assistant Examiner*—Joni B. Danganan
(74) *Attorney, Agent, or Firm*—Robert W. Becker & Associates

(57) ABSTRACT

The socket wrench extension has an insertion member with a polygonal socket head having a lateral socket head surface. A receiving member with a polygonal socket is provided and a tube rigidly connects the insertion member and the receiving member. The locking member is moveably connected within the insertion member such that the locking element partially projects from the lateral socket head surface. The pressure transmission member is axially moveable in the tube. The pressure transmission member has a first and a second end. The first end serves as an actuation member for the pressure transmission member. The second end transforms the axial movement of the pressure transmission member, directed toward the insertion member, into an outward movement of the locking member. The receiving member has an axial bore and a guide sleeve which is inserted into the axial bore of the receiving member for guiding the first end of the pressure transmission member. The guide sleeve has an insertion diameter (press-fit diameter) that is greater than the maximum diameter of the pressure transmission member.

4 Claims, 1 Drawing Sheet

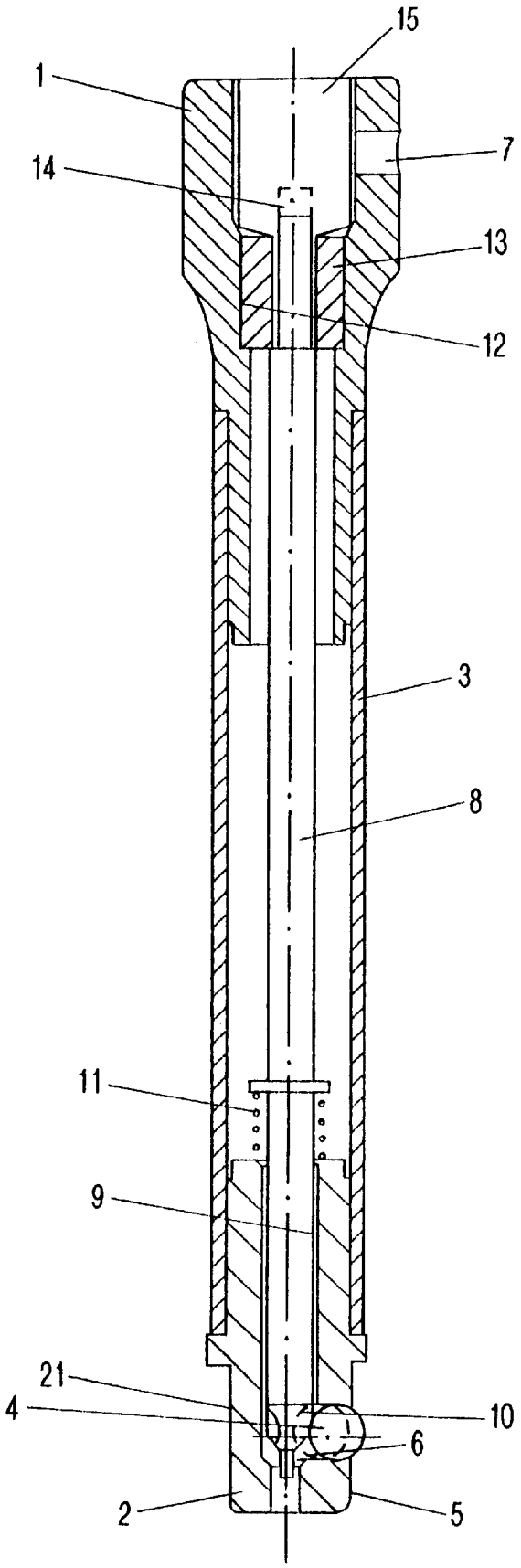
15
1
7
14
13
12
3
8
11
9
21
4
10
6
2
5

SOCKET WRENCH EXTENSION

BACKGROUND OF THE INVENTION

The present invention relates to a socket wrench extension comprising a polygonal insertion member and a correspondingly designed receiving member at the other end. The insertion member comprises a locking member that partially projects from a lateral socket head surface. A pressure transmission member is axially guided in the insertion member and has a pin-shaped or key-shaped end that serves as a pressure actuation of the pressure transmission member and has another end that is a component of a mechanism for transforming an axial movement of the pressure transmission member in the direction toward the insertion member into an outward movement of the locking member.

Such locking members are provided in order to snap into position by a spring force into a matching recess of a receiving member into which the insertion member of the socket wrench extension is to be inserted. In general, this is the receiving member of a socket wrench insert. By snapping into position in the recess, the locking member prevents easy separation of the two tool parts because they are connectable and releasable only by applying a certain force. However, it often occurs that the parts become accidentally detached, for example, when the socket wrench extension with socket wrench insert connected thereto must be removed from a screw or nut when in a slightly slanted position. Between the socket wrench insert and the screw or the nut frictional forces may occur that are greater than the locking forces of the spring-loaded locking member.

A socket wrench extension of the aforementioned kind is known from U.S. Pat. No. 5,289,745. Such socket wrench extensions are embodied as a single-piece component, which, depending on its respective embodiment, has a concentrically or eccentrically arranged longitudinal bore for receiving an actuating rod. The longitudinal bore is embodied either as a throughbore or as a blind bore. While in the first case an end cap is required at the end face of the polygonally embodied insertion member, in the latter case an abutment ring, secured by a washer and a spring ring is provided in a receiving member adjacent to the bore in order to effect axial fixation of the actuation rod. A disadvantage of these known socket wrench extensions is that the axial guiding action of the guiding rod is in all cases realized by a longitudinal bore so that high standards in regard to machining tolerances for providing a precise guiding action are necessary. This makes the manufacture of such extensions very expensive. A further disadvantage of the known socket wrench extensions is that the locking member is positioned in a transverse bore within the insertion member and is secured therein by a securing screw or an end cap against falling out. This requires a great number of components, and thus results in a cost-intensive manufacture and mounting.

It is therefore an object of the invention to improve a socket wrench extension of the aforementioned kind such that with a simple assembly and reduced manufacturing costs a high functional precision is achieved.

SUMMARY OF THE INVENTION

This object is inventively solved for a socket wrench extension of the aforementioned kind by the inventive features, including a rigid tube that connects the insertion member and the receiving member in which the pressure transmission member is arranged and a guide sleeve for axially guiding the pressure transmission member in the receiving portion. The guide sleeve is inserted into the throughbore of the receiving bore and is preferable pressed into it (press-fit attachment) whereby the insertion or press-fit diameter of the guide sleeve is greater than the maximum diameter of the pressure transmitting member.

A socket wrench embodied as suggested allows a simple and fast assembly. Additionally, an inexpensive manufacture is ensured. This is so because the locking member, before assembly of the socket wrench extension, can be inserted into the insertion member through the bore provided for receiving the pressure transmission member. Upon insertion of the pressure transmission member, the locking member is secured in the insertion member without additional securing elements. After completion of assembly, i.e., attaching the receiving member, insertion member, and tube, the pressure transmission member can be inserted through the throughbore for the guide sleeve. This is made possible because the insertion diameter or the press-fit diameter of the guide sleeve is greater than the maximum diameter of the pressure transmission member. The final step of inserting the guide sleeve provides the pressure transmission members with axial guiding action, i.e., it is fixed in the axial direction. The guide sleeve can be made of a suitable material having a minimal frictional coefficient in order to provide a smooth axial guiding action.

With the inventive socket wrench extension a secure attachment of the inserted socket wrench insert at the socket wrench extension is provided. The pressure transmitting member is guided in the insertion member of the socket wrench extension. It has a first end that transmits the pressure and a second end that is a component of a mechanism for transforming the movement of the pressure transmitting members into an outward movement of the locking members. In one embodiment of the invention it is suggested that the second end of the pressure transmitting member is provided with a slant which rests at the radially guided locking members.

In order to provide a return force it is suggested, according to another embodiment of the invention, to provide a spring which exerts a force onto the pressure transmission member in the direction toward the pin-shaped or key-shaped end thereof. Preferably, the spring is supported with one end at the insertion member and with the other end at the pressure transmission member.

BRIEF DESCRIPTION OF THE DRAWINGS

The object and advantages of the present invention will appear more clearly from the following specification in conjunction with the accompany only drawing in which the socket wrench extension is shown in a sectional view.

DESCRIPTION OF PREFERRED EMBODIMENTS

The present invention will now be described in detail with the aid of a specific embodiment utilizing the only figure.

The extension to be used in connection with a socket wrench system is comprised of a receiving member 1 having a square receiving socket and in insertion member 2 having a square socket head 5 with a lateral socket head surface 21. A tube 3 rigidly connects the receiving member 1 and insertion member 2. The socket head surfaces and the socket surfaces of the receiving member 1 and the insertion member 2 correspond to the standardized international dimensions of socket wrench systems.

In a manner well known to a person skilled in the art, the insertion member 2 has a locking element 4 in the shape of a ball which projects from one of the socket head surfaces 21. Upon insertion of the socket head 5 into a square receiving socket, as, for example, provided within the receiving member 1, the locking element 4 is radially inwardly moved into the radial bore 6 and can subsequently snap into the recess provided at the socket head 5. Such a recess is realized in the receiving member 1 by a corresponding bore 7.

In known systems, the return of the ball-shaped locking member 4 into the radial bore 6 is performed counter to the force of a spring arranged in the bore. In this matter, the force which secures the socket head 5 in a corresponding square socket also depends on that spring force.

In contrast, the inventive locking member 4 shown in the drawing does not rest directly at a spring but at a pressure transmission member 8 in the shape of a rod. The pressure transmission member 8 is arranged in a longitudinal bore 9 of the insertion member 2 and has at its end a slant 10 which rests at the ball-shaped locking member 4. Within the tube 3 the pressure transmission element 8 is supported by a spring 11 at the inner end face of the insertion member 2. The spring 11 is arranged such that it exerts a force onto the pressure transmission member 8 which forces the pressure transmission member 8 away from the insertion member 2 and in the direction toward the receiving member 1. Since the slant 10 in connection with the locking member 4 provides a mechanism for transforming the axial movement of the pressure transmission element 8 into a substantially radial movement of the locking member 4, the spring 11 in its unloaded state allows the ball-shaped locking member 4 to return inwardly into its radial bore 6. However, measures are provided in order to prevent the moveable ball in this state from falling out of the insertion member 2.

The rod which provides the pressure transmission member 8 is axially guided also within the receiving member 1. The receiving member 1 is provided with a throughbore 12 into which a guide sleeve 13 is press-fitted. It axially guides the pressure transmission member 8 and also provides an abutment which limits the longitudinal travel of the pressure transmission element 8. The insertion or press-fit diameter of the guide sleeve 13 is greater than the maximum diameter of the pressure transmission member 8. In this manner, a simplified assembly of the pressure transmission member 8 and of the spring 11 is realized.

In order to assemble the socket wrench extension represented in the drawing, the ball-shaped locking member 4 is first pushed through the longitudinal bore 9 into its radial bore 6. Subsequently, the receiving member 1, the insertion member 2, and the tube 3 are connected to one another, preferably by press fitting within the inner wall of the tube 3. The pressure transmission member 8 is then guided, with the spring 11 attached thereto and through the receiving member 1, through the socket wrench extension into the shown position. Subsequently, the guide sleeve 13 is inserted through the receiving socket 15 and press-fitted into the throughbore 12. The length of the pressure transmission member 8 is such that its pin-shaped end 14 projects from the guide sleeve 13 into the receiving socket 15 of the receiving member 1. The pin-shaped end 14 serves in this manner as a pressure actuation of the pressure transmission member 8 as soon as a socket head is received in the square receiving socket 15, for example, when a ratchet socket is inserted. The pressure transmission member 8 has the function of a plunger whose axial movement is transformed by the slant 10 into a radially outwardly oriented movement of the locking member 4 so that it is securely fixed in the position shown in a solid line in the drawing. An inserted socket wrench therefore cannot become detached even when forces are applied.

The specification incorporates by reference the disclosure of German priority document 197 44 865.8 of Oct. 10, 1997.

The present invention is, of course, in no way restricted to the specific disclosure of the specification and drawings, but also encompasses any modifications within the scope of the appended claims.

What is claimed is:

1. A socket wrench extension comprising:

an insertion member (2) having a polygonal socket head (5) and a first connecting portion opposite said polygonal socket head (5);

said insertion member (2) having a lateral socket head surface (21);

a receiving member (1) having a polygonal receiving socket (15) and a second connecting portion opposite said polygonal receiving socket (15);

a tube (3) having an inner diameter matching an outer diameter of said first and second connecting portions and rigidly connecting said insertion member (2) and said receiving member (1) by engaging said first and second connecting portions;

a locking member (4) moveably connected within said insertion member (2) such that said locking member (4) partially projects from said lateral socket head surface (21);

a pressure transmission member (8) axially moveable in said tube (3) and radially spaced from an inner wall of said tube (3);

said pressure transmission member (8) having a first end and having a second end (10);

said first end (14) serving as an actuating member for said pressure transmission member (8);

said second end (10) transforming axial movement of said pressure transmission member (8), directed toward said insertion member (2), into an outward movement of said locking member (4);

said receiving member (1) having an axial bore (12);

a guide sleeve (13) inserted in said axial bore (12) of said receiving member (1) for guiding said first end of said pressure transmission member (8);

said insertion member (2) having a longitudinal bore (9) in which said second end of said pressure transmission member (8) is received, wherein said pressure transmission member (8) is guided only by said guide sleeve (13) and said longitudinal bore (9) of said insertion member (2);

wherein said guide sleeve (13) has an insertion diameter that is greater than a maximum diameter of said pressure transmission member (8).

2. A socket wrench extension according to claim 1, wherein:

said second end (10) has a slant (10);

said locking member (4) is radially moveable in said insertion member (2); and said slant (10) rests on said locking member (4).

3. A socket wrench extension according to claim 1, further comprising a spring (11) arranged on said pressure transmission member (8) and acting on said pressure transmission member (8) in a direction toward said first end (14).

4. A socket wrench extension according to claim 3, wherein said spring (11) has a first end resting against said insertion member (2) and has a second end resting against said pressure transmission member (8).

* * * * *